US010932355B2

(12) United States Patent
Ciovati et al.

(10) Patent No.: US 10,932,355 B2
(45) Date of Patent: Feb. 23, 2021

(54) HIGH-CURRENT CONDUCTION COOLED SUPERCONDUCTING RADIO-FREQUENCY CRYOMODULE

(71) Applicant: JEFFERSON SCIENCE ASSOCIATES, LLC, Newport News, VA (US)

(72) Inventors: Gianluigi Ciovati, Yorktown, VA (US); Thomas J. Schultheiss, Commack, NY (US); John Rathke, Centerport, NY (US); Robert Rimmer, Yorktown, VA (US); Frank Marhauser, Yorktown, VA (US); Fay Hannon, Poquoson, VA (US); Jiquan Guo, Yorktown, VA (US)

(73) Assignee: JEFFERSON SCIENCE ASSOCIATES, LLC, Newport News, VA (US)

( * ) Notice: Subject to any disclaimer, the term of this patent is extended or adjusted under 35 U.S.C. 154(b) by 520 days.

(21) Appl. No.: 15/882,211

(22) Filed: Jan. 29, 2018

(65) Prior Publication Data

US 2019/0098741 A1 Mar. 28, 2019

Related U.S. Application Data

(60) Provisional application No. 62/563,274, filed on Sep. 26, 2017.

(51) Int. Cl.

| | |
|---|---|
| ***H05H 7/20*** | (2006.01) |
| ***H05H 7/02*** | (2006.01) |
| ***F17C 3/08*** | (2006.01) |

(52) U.S. Cl.
CPC ..... *H05H 7/20* (2013.01); *F17C 3/085* (2013.01); *H05H 7/02* (2013.01); *H05H 2007/025* (2013.01); *H05H 2242/10* (2013.01)

(58) Field of Classification Search
CPC ..... H05H 7/20
See application file for complete search history.

(56) References Cited

U.S. PATENT DOCUMENTS 4,397,081 A * 8/1983 Ziemek ..... H01B 12/12 29/599
5,396,206 A 3/1995 Herd et al.
(Continued)

OTHER PUBLICATIONS

Hahn et al., Higher-Order-Mode absorbers for energy recovery . . . , Physical Review Special Topics—Accelerators and Beams, published 122/03,2010, vol. 13, pp. 121002-1 to 121002-14.
(Continued)

*Primary Examiner* — Paul A Wartalowicz

(57) ABSTRACT

A high-current, compact, conduction cooled superconducting radio-frequency cryomodule for particle accelerators. The cryomodule will accelerate an electron beam of average current up to 1 ampere in continuous wave (CW) mode or at high duty factor. The cryomodule consists of a single-cell superconducting radio-frequency cavity made of high-purity niobium, with an inner coating of $Nb_3Sn$ and an outer coating of pure copper. Conduction cooling is achieved by using multiple closed-cycle refrigerators. Power is fed into the cavity by two coaxial couplers. Damping of the high-order modes is achieved by a warm beam-pipe ferrite damper.

17 Claims, 4 Drawing Sheets

(56) References Cited

U.S. PATENT DOCUMENTS

| | | | | |
|---|---|---|---|---|
| 5,465,068 | A * | 11/1995 | Darges | H03F 3/602 327/323 |
| 5,491,411 | A * | 2/1996 | Wellstood | G01R 33/0354 324/248 |
| 5,497,050 | A | 3/1996 | Cheo | |
| 5,504,341 | A | 4/1996 | Glavish | |
| 6,025,681 | A | 2/2000 | Yu et al. | |
| 6,281,622 | B1 | 8/2001 | Valentian et al. | |
| 6,348,757 | B1 | 2/2002 | Marini | |
| 6,864,633 | B2 | 3/2005 | Trail et al. | |
| 7,239,095 | B2 | 7/2007 | Ho et al. | |
| 8,674,630 | B1 | 3/2014 | Cornelius | |
| 8,812,068 | B1 * | 8/2014 | Kelley | H05H 7/20 505/210 |
| 9,107,281 | B2 | 8/2015 | Yamamoto et al. | |
| 9,485,849 | B1 * | 11/2016 | Vetter | H05H 9/044 |
| 9,642,239 | B2 | 5/2017 | Kephart | |
| 2007/0237300 | A1 * | 10/2007 | Kim | H01J 35/065 378/122 |
| 2007/0249399 | A1 | 10/2007 | Wu et al. | |
| 2009/0184252 | A1 * | 7/2009 | Tanaka | G01T 1/1606 250/370.09 |
| 2016/0301180 | A1 * | 10/2016 | Nikipelov | H01J 1/34 |
| 2017/0094770 | A1 | 3/2017 | Kephart | |

OTHER PUBLICATIONS

Kikuzawa et al., "Performance of Compact Refrigerators . . . ", Proceedings of the 1997 Workshop on RF Superconductivity, Abamo Terma (Padova). Italy, (1997), SRF97C40,pp. 769-773.

* cited by examiner

HIGH-CURRENT CONDUCTION COOLED SUPERCONDUCTING RADIO-FREQUENCY CRYOMODULE

CROSS-REFERENCE TO RELATED APPLICATIONS

This application claims the priority of Provisional U.S. Patent Application Ser. No. 62/563,274 filed Sep. 26, 2017.

GOVERNMENT LICENSE RIGHTS STATEMENT

This invention was made with government support under Management and Operating Contract No. DE-AC05-06OR23177 awarded by the Department of Energy. The United States Government has certain rights in the invention

FIELD OF THE INVENTION

The present invention relates to superconducting radio-frequency (SRF) cryomodules used in particle accelerators, and in particular to a compact, conduction-cooled SRF cryomodule suitable to accelerate a high-current beam.

BACKGROUND OF THE INVENTION

Superconducting Radio-Frequency (SRF) accelerators are important tools for scientific research due to the small RF losses and the higher continuous-wave (CW) accelerating fields than normal conducting cavities. These devices are predominantly used in nuclear and high-energy physics research, as well as light sources for experiments in material and biological sciences. In conventional SRF accelerators, the superconducting state is achieved by cooling niobium SRF cavities, the accelerating structures inside the cryomodule, to below the transition temperature of 9.2K, typically to 4.3 K or lower, by means of immersing them in a liquid helium (He) bath.

Cryogenic plants required to supply the liquid helium to SRF cryomodules are complex, of substantial size, constitute a major fraction of the capital and operating cost of SRF accelerators, and are one of the main obstacles towards a more widespread use of SRF technology. Although SRF technology is applicable to many industrial applications, such as environmental remediation, the high cost of producing and operating the cryogenic plant substantially limits the application of SRF technology.

Accordingly, what is needed is a compact, low-cost SRF accelerator for cost-effective use in industrial applications such as environmental remediation, which includes the treatment of waste-water and flue-gases. An SRF electron accelerator required for those applications should be capable of operating at high-current (~1 ampere) and low energy (1-10 MeV).

OBJECT OF THE INVENTION

An object of this invention is to provide a compact, conduction cooled, high-current SRF cryomodule for use in particle accelerators for industrial applications.

A further object is to provide an SRF cryomodule that greatly reduces the capital cost, operating cost, and operational complexity of a cryomodule for use in a particle accelerator.

A further object is to provide an SRF cryomodule that eliminates the need for a helium liquefier, a pressure vessel, and a cold tuner.

Another object is to significantly lower investment and operating costs of an SRF accelerator.

A further object is to provide an SRF cryomodule that is free of liquid cryogen hazards.

Another object of the invention is to provide an SRF cryomodule in which the conventional cryogenic plant is replaced by a closed-cycle refrigerator at much lower cost.

A still further object of the invention is to provide a compact, conduction-cooled SRF cryomodule capable of accelerating a high-current beam operating at a current of 1 ampere or greater and at an energy of 1-10 MeV.

A still further object of the invention is to provide a high current SRF cryomodule that can be used for cleaning flue gases, such as converting nitrous oxides in the flue gases, or for treating wastewater streams, such as hospital or municipal waste streams, to remove biological materials, or to modify the sludge in waste treatment plants.

These and other objects and advantages of the present invention will be better understood by reading the following description along with reference to the drawings.

BRIEF SUMMARY OF THE INVENTION

The present invention is a compact, conduction-cooled, high-current SRF cryomodule for particle accelerators. The cryomodule includes a multi-layer SRF cavity, dual coaxial input couplers, high-order modes (HOM) dampers, thermal shield, magnetic shields, support structure, a vacuum vessel and multiple cryocoolers. In such a cryomodule, the cryogenic plant is replaced by commercial Gifford-McMahon (GM) closed-cycle refrigerators at much lower cost. The SRF cryomodule will allow the development of low-cost SRF accelerators for industrial applications, particularly for environmental remediation.

BRIEF DESCRIPTION OF THE SEVERAL VIEWS OF THE DRAWINGS

Reference is made herein to the accompanying drawings, which are not necessarily drawn to scale and wherein.

DETAILED DESCRIPTION OF THE INVENTION

Figure 2:
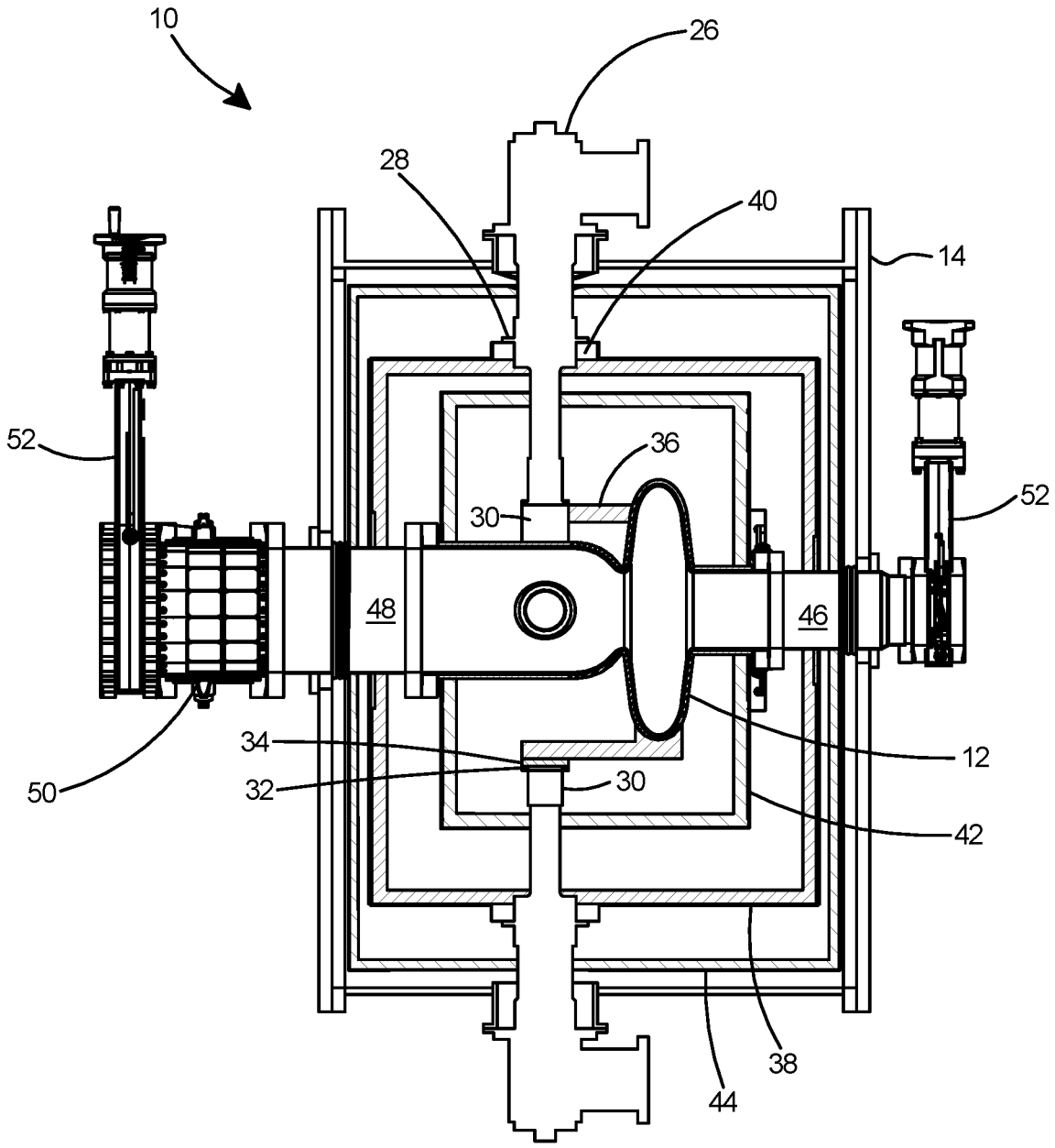
FIG. 2 is a sectional view of the SRF cavity taken along line 2-2 of FIG. 1.

With reference to FIG. 2, the invention is a compact, conduction cooled SRF cryomodule 10 for accelerating a high current beam. The meaning of "high current beam" as used herein refers to a beam that includes a current of up to or greater than 1 ampere. The meaning of "compact" as used herein refers to a conduction cooled SRF cryomodule that has an overall size of 1.5 m by 1.5 m or less. The conduction cooled SRF cryomodule 10 includes an SRF cavity 12 located inside a vacuum vessel 14. FIG. 2 depicts a single-cell cavity although other arrangements such as multiple-cell cavities are within the scope of the invention.

The SRF cavity 12 is preferably of elliptical shape and geometric β tailored to the energy of the incoming beam. The SRF cavity 12 is preferably fabricated from high-purity niobium (Nb) having a residual resistivity ratio of greater than 300 and includes a thickness of 3-5 millimeters. Alternatively, metals with thermal conductivity greater than 500 W/(m K) at 4 K, such as tungsten or copper, could also be used.

Figure 3:
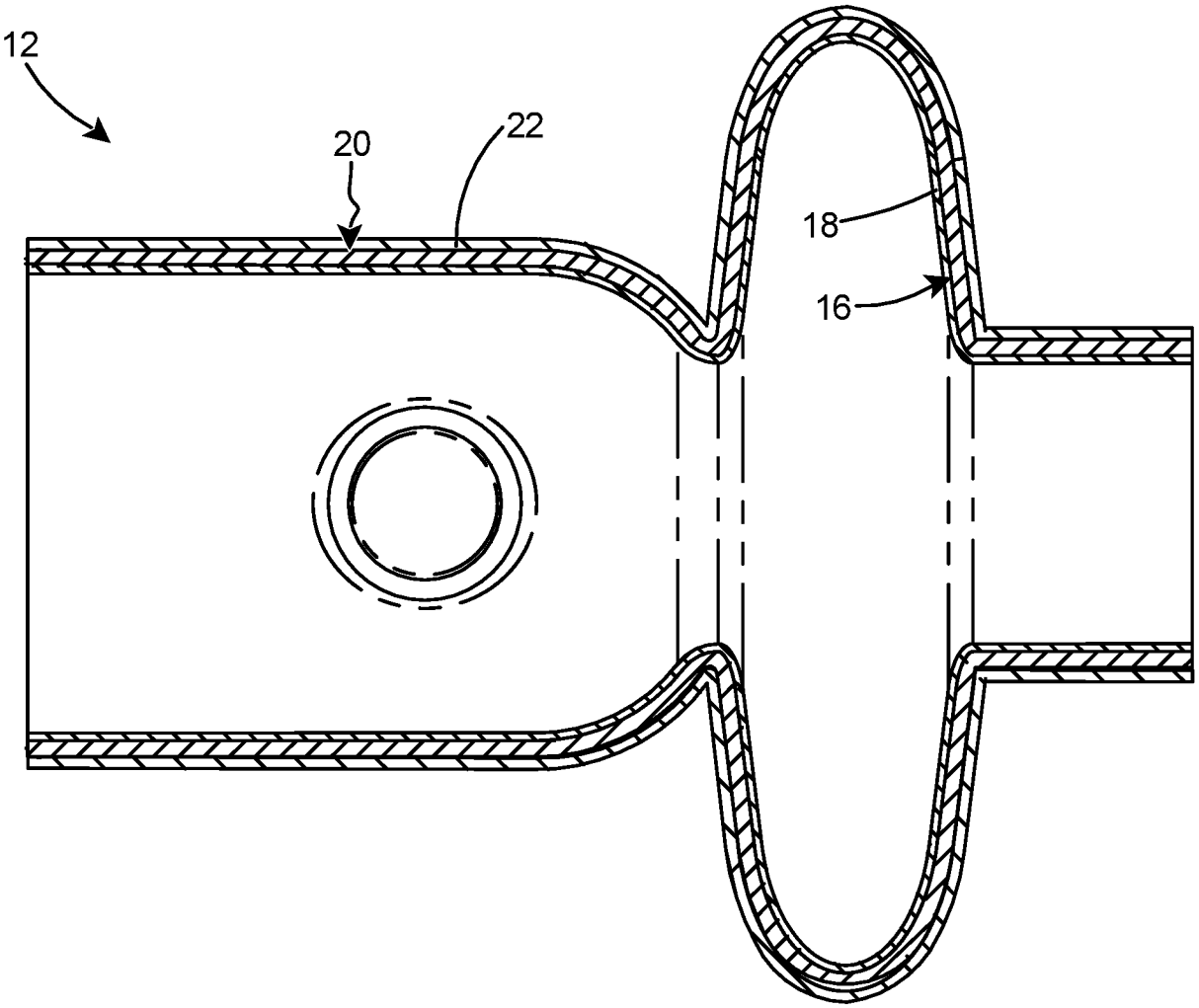
FIG. 3 is a sectional view of an SRF cavity that forms a portion of the SRF cryomodule according to the present invention.
Figure 4:
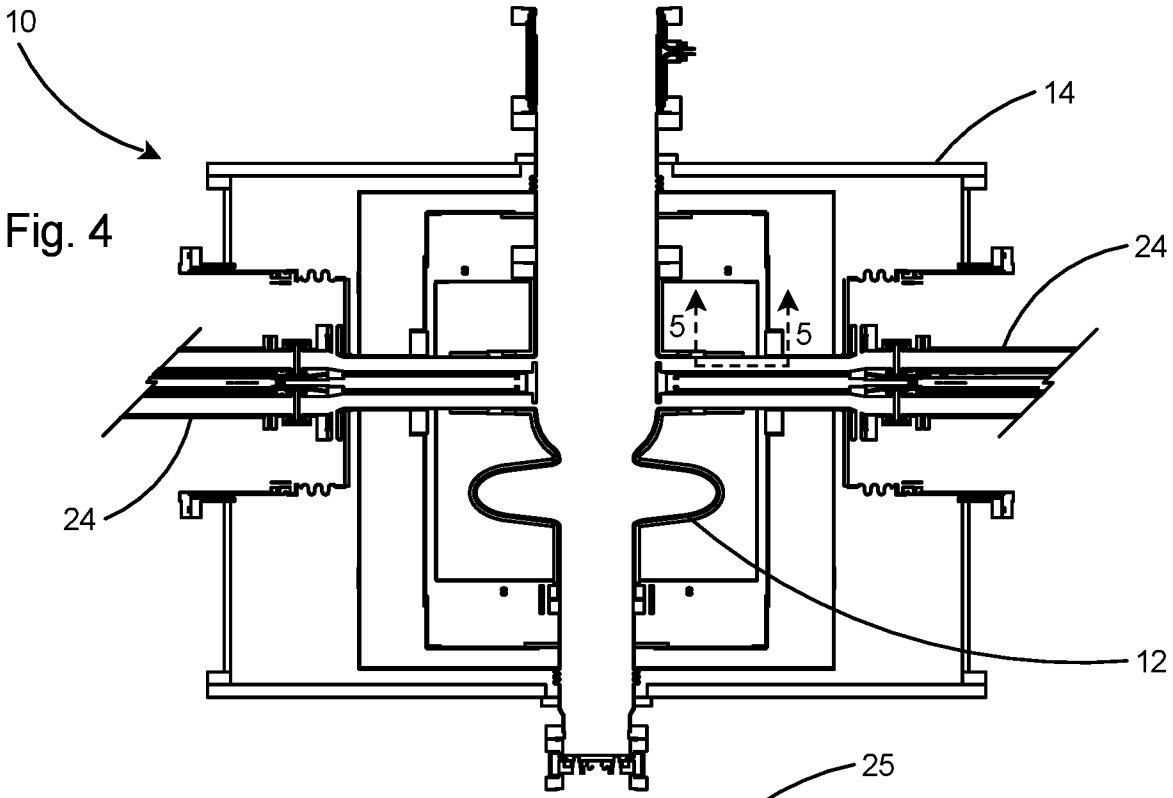
FIG. 4 is a is a sectional view of the SRF cryomodule taken along line 4-4 of FIG. 1.

As shown in FIG. 3, the cavity inner surface 16 is coated with a thin (1-1.5 μm thick) superconducting inner layer 18 preferably formed by thermal diffusion of Sn vapor in a vacuum furnace at 1000-1200° C. The inner layer 18 is preferably constructed of $Nb_3Sn$, $Nb_3Ge$, NbN, or NbTiN, and is most preferably constructed of $Nb_3Sn$. The thin film coating is a superconductor having a critical temperature greater than 15 K. The use of $Nb_3Sn$ as the inner layer 18 of the cavity results in an SRF cavity with substantially lower RF losses as compared to an uncoated cavity constructed of bulk Nb at 4.3 K.

The SRF cavity 12 outer surface 20 is coated with a layer 22 preferably of copper or tungsten, and most preferably of pure copper having a purity of greater than 99.98%. The method of applying the outer layer 22 is preferably by electroplating, vacuum plasma spraying, or by a combination of vacuum plasma-spraying and electroplating. The outer coating is not required if the cavity is fabricated from a metal other than Nb.

Figure 1:
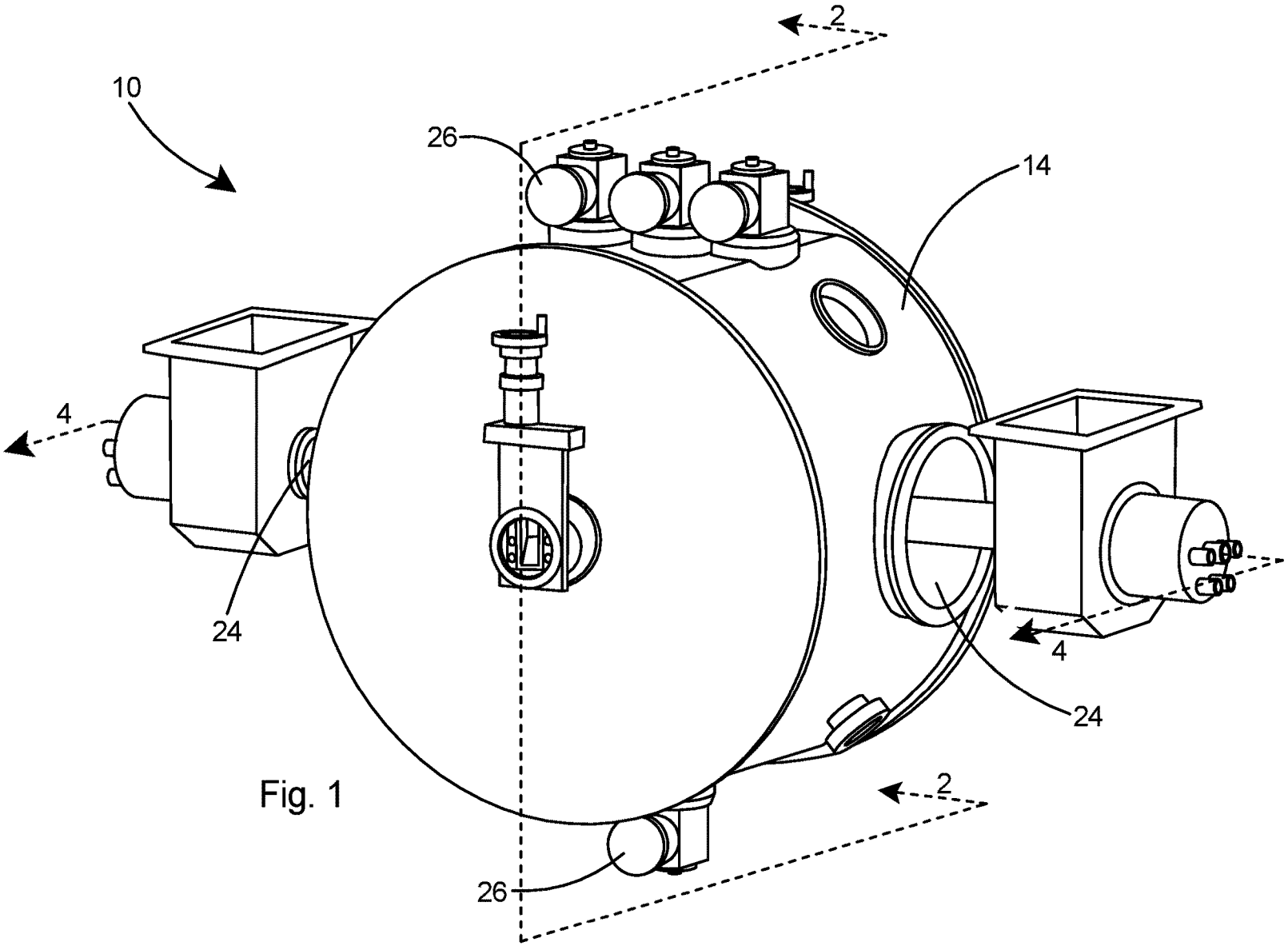
FIG. 1 is a perspective view of a cryomodule vacuum vessel that houses a conduction-cooled, high-current SRF cryomodule according to the present invention.
Figure 5:
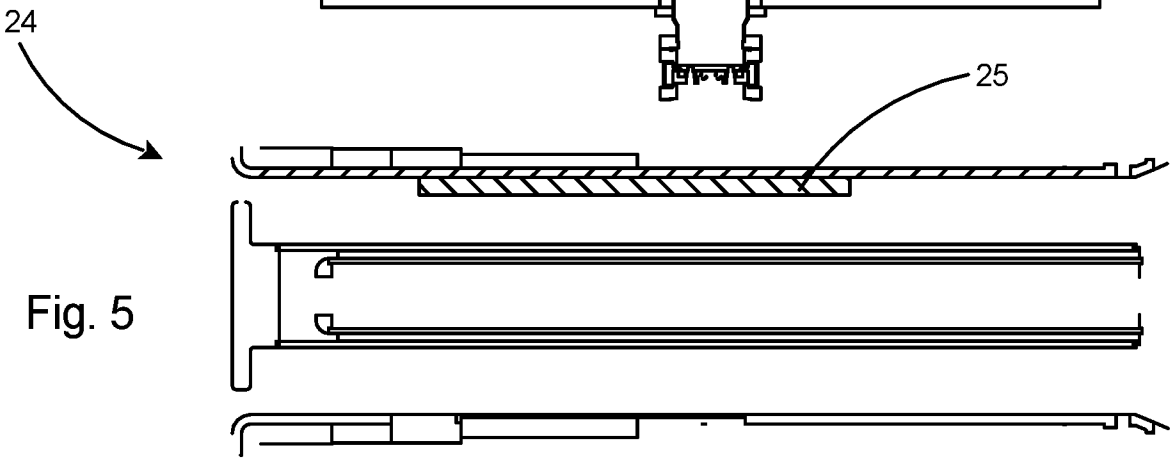
FIG. 5 is a is a sectional view of the power coupler taken along line 5-5 of FIG. 4.

Referring to FIG. 1, two symmetrically located coaxial power couplers 24 are used to feed RF power into the SRF cavity 12. Each power coupler 24 is capable of sustaining a minimum of 500 kW of RF power into the SRF cavity 12. As shown in FIG. 5, a section of the inner surface of the outer conductor of the power coupler is preferably coated with a thin layer 25 (1-1.5 μm thick) of a high-temperature superconductor to minimize the static and dynamic heat load from the coupler. Preferably, the thin layer 25 of high-temperature superconductor material is YBCO (yttrium barium copper oxide) having a critical temperature greater than 90 K. The high-temperature superconductor is preferably applied to the inner surface of the outer conductor by methods including physical-chemical vapor deposition, pulsed laser deposition, or a combination of physical-chemical vapor deposition and pulsed laser deposition.

With reference to FIG. 2, cooling of the SRF cavity to below 15 K, preferably to less than or equal to 4.3 K, is provided by one or more cryocoolers 26. The cryocoolers 26 each include a first stage cold head 28 and a second stage cold head 30. The second stage cold head 30 of each cryocooler is connected to the SRF cavity 12 by means of a mechanical contact joint 32 with a malleable indium interlayer 34 and a high thermal conductivity strain relief section 36. The outer copper layer 20 (see FIG. 3) of the SRF cavity 12 will provide a high thermal conduction path from the SRF cavity surfaces to the cryocooler second stage cold heads 30. The first stage cold head 28 of the cryocooler is preferably at a temperature of 50-80 K and the second stage cold head 30 of the cryocooler is preferably at a temperature of 4.3-9 K A preferred cryocooler such as described herein is the Gifford-McMahon (GM) type cryocooler, available from Sumitomo (SHI) Cryogenics of America, in Allentown, Pa. Most preferably, the cryocooler 26 would have a second stage capacity greater than or equal to 1.5 watts W at 4.2 K. A preferred strain relief section is preferably constructed of copper or tungsten and most preferably consists of copper thermal straps such as those available from Technology Applications, Inc., in Boulder, Colo.

With reference to FIG. 2, the conduction cooled SRF cryomodule 10 preferably includes a thermal shield 38 with a structure core 40, wherein said structure core is connected to the cryocooler first stage cold heads 28 by means of a mechanical contact joint with a malleable indium interlayer. High thermal conductivity strain relief sections are located along the shield structure core 40. Thermal shield 38, preferably constructed of oxygen-free electronic copper, takes infrared heat away from the SRF cavity. Multi-layer insulation blankets are wrapped around the thermal shield to further reduce radiative heat transfer.

Magnetic fields are preferably minimized in the SRF cavity 12 through the use of an inner magnetic shield 42 and an outer magnetic shield 44. With reference to FIG. 2, the magnetic shields are preferably constructed of a material with the ability to support the absorption of a magnetic field within itself. The magnetic shields are constructed of a shielding alloy that will attract magnetic flux lines of the interfering fields to itself and divert the unwanted field away from sensitive areas or components. The magnetic shields are preferably constructed of a high permeability metal having high magnetic shielding properties. The magnetic shields are most preferably constructed of MuMETAL®, a metal alloy available from Magnetic Shield Corporation of Bensenville, Ill., CRYOPERM® 10 or Amumetal 4K, both available from Amuneal Manufacturing Corp., in Philadelphia, Pa. Most preferably, multi-layer insulation blankets are wrapped around the inner magnetic shield.

With reference to FIG. 2, the conduction cooled SRF cryomodule 10 according to the present invention preferably includes an entrance beam tube 46 and an exit beam tube 48 connected to the SRF cavity 12. Most preferably, damping of the high-order modes of the accelerated particles is achieved by enlarging the exit beam tube 48 of the SRF cavity. As shown in FIG. 2, the diameter of the exit beam tube 48 is larger than the diameter of the entrance beam tube 46. Preferably, the SRF cryomodule includes a water-cooled beam pipe higher-order mode ferrite damper 50 for damping of higher-order modes and allowing their propagation to a room-temperature. A conduction cooled SRF cryomodule 10 with 1 MW RF power fed into the SRF cavity by the power couplers 24 is capable of generating a 1 ampere beam (high current SRF beam) at 1 MW RF power.

The volume within the cavity is isolated from the outside environment by means of two vacuum valves 52 outside the vacuum vessel, which are preferably all-metal gate valves. A vacuum valve 52 is included on the entrance 46 and on the exit beam tube 48.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments herein were chosen and described in order to best explain the principles of the invention and the practical application, and to enable others of ordinary skill in the art to understand the invention for various embodiments with various modifications as are suited to the particular use contemplated.

What is claimed is:

1. A superconducting radio-frequency (SRF) cryomodule for accelerating an electron beam, comprising:

a vacuum vessel;

an SRF cavity within said vacuum vessel;

a coaxial input power coupler extending through said vacuum vessel and connected to said SRF cavity;

a cryocooler having a cold head, said cold head connected to the SRF cavity;

a water-cooled beam pipe higher-order mode absorber for damping of high-order modes;

a thermal shield;

a magnetic shield;

an entrance beam tube and an exit beam tube;

said coaxial input power coupler including an outer conductor having an inner surface; and said inner surface of said outer conductor of said power coupler includes a section with a layer of high-temperature superconductor.

2. The SRF cryomodule of claim 1 further comprising:

said SRF cavity is selected from the group consisting of niobium (Nb) and metal with thermal conductivity greater than 500 W/(m K) at 4 degrees K;

said RF cavity includes an inner surface;

said inner surface of said SRF cavity is includes a thin film coating for reducing RF losses; and said thin film coating is a superconductor having a critical temperature greater than 15 K.

3. The SRF cryomodule of claim 2 further comprising:

said thin film coating is 1 to 1.5 μm thick; and said thin film coating is selected from the group consisting of $Nb_3Sn$, $Nb_3Ge$, NbN, and NbTiN; and said cryocooler maintaining said SRF cavity at 4.3 K.

4. The SRF cryomodule of claim 1 further comprising:

said SRF cavity includes an outer surface;

said outer surface of said SRF cavity includes a coating; and said coating on said outer surface of said SRF cavity is selected from the group consisting of copper and tungsten.

5. The SRF cryomodule of claim 4 wherein said coating on said outer surface of said SRF cavity is deposited on said SRF cavity by vacuum plasma-spraying, electroplating, or by a combination of vacuum plasma-spraying and electroplating.

6. The SRF cryomodule of claim 1 further comprising said high-temperature superconductor having a critical temperature greater than 90 K.

7. The SRF cryomodule of claim 6 further comprising said layer of high-temperature superconductor is applied to said inner surface of said outer conductor by methods selected from the group consisting of physical-chemical vapor deposition, pulsed laser deposition, and a combination of physical-chemical vapor deposition and pulsed laser deposition.

8. The SRF cryomodule of claim 1 wherein said (SRF) cryomodule includes an electron beam current of at least 1 ampere at an energy of 1 to 10 MeV.

9. The SRF cryomodule of claim 1 further comprising:

said entrance beam tube having a diameter and said exit beam tube having a diameter; and said diameter of said exit beam tube is larger than the diameter of said entrance beam tube.

10. The SRF cryomodule of claim 1 further comprising:

an entrance beamline ultra-high vacuum valve on said entrance beam tube; and an exit beamline ultra-high vacuum valve on said exit beam tube.

11. The SRF cryomodule of claim 1 wherein said coaxial input power coupler is capable of sustaining a minimum of 500 kilowatt of power.

12. The SRF cryomodule of claim 1 further comprising:

said cryocooler includes a first stage cold head and a second stage cold head;

said first stage cold head of said cryocooler is at a temperature of 50-80 K; and said second stage cold head of said cryocooler is at a temperature of 4.3-9 K.

13. The SRF cryomodule of claim 1 further comprising:

said magnetic shield including an inner and an outer magnetic shield; and said inner and outer magnetic shields are constructed of a high permeability metal having high magnetic shielding properties, and said thermal shield is constructed of oxygen free electronic copper.

14. The SRF cryomodule of claim 1 wherein said water-cooled beam pipe higher-order mode absorber is a ferrite damper.

15. The SRF cryomodule of claim 1 wherein said cryocoolers each provide a cooling power greater than or equal to 1.5 watt at 4.2 K.

16. A superconducting radio-frequency (SRF) cryomodule for accelerating an electron beam, comprising:

a vacuum vessel;

an SRF cavity within said vacuum vessel;

a coaxial input power coupler extending through said vacuum vessel and connected to said SRF cavity;

a cryocooler having a cold head, said cold head connected to the SRF cavity;

a water-cooled beam pipe higher-order mode absorber for damping of high-order modes;

a thermal shield;

a magnetic shield;

an entrance beam tube and an exit beam tube;

a high thermal conductivity strain relief section between said second stage cold head and said SRF cavity; and said high thermal conductivity strain relief section is selected from the group consisting of copper and tungsten.

17. A method for accelerating an electron beam to an electron beam current of at least 1 ampere at an energy of 1 to 10 MeV, comprising:

providing a superconducting radio-frequency (SRF) cryomodule including a vacuum vessel, an SRF cavity within said vacuum vessel, an coaxial input power coupler extending through said vacuum vessel and connected to said SRF cavity, a cryocooler having a cold head, said cold head connected to the SRF cavity, an entrance beam tube and an exit beam tube, a thermal shield, a magnetic shield, said coaxial input power coupler including an outer conductor having an inner surface; said inner surface of said outer conductor of said power coupler includes a section with a layer of high-temperature superconductor, and a water-cooled beam pipe higher-order mode absorber on said exit beam tube;

cooling said SRF cavity to between 4.3 K and 9 K with said cryocooler;

providing said exit beam tube with a greater diameter than said entrance beam tube to damp high-order modes in said SRF cavity;

further damping high-order modes in said SRF cavity with said water-cooled beam pipe higher-order mode absorber;

removing infrared heat generated by the SRF cavity with said thermal shield; and removing magnetic flux lines of interfering magnetic fields with said magnetic shield.

* * * * *